United States Patent [19]

Kratz

[11] Patent Number: 4,773,507

[45] Date of Patent: Sep. 27, 1988

[54] ARRANGEMENT FOR MOUNTING A LIFT DRIVING DEVICE

[75] Inventor: Bengt Kratz, Upsala, Sweden

[73] Assignee: Inliftor AB, Upsala, Sweden

[21] Appl. No.: 64,946

[22] PCT Filed: Oct. 9, 1986

[86] PCT No.: PCT/SE86/00466

§ 371 Date: May 20, 1987

§ 102(e) Date: May 20, 1987

[87] PCT Pub. No.: WO87/02344

PCT Pub. Date: Apr. 23, 1987

[30] Foreign Application Priority Data

Oct. 9, 1985 [SE] Sweden ..... 8504678

[51] Int. Cl.[4] ..... B66B 11/08

[52] U.S. Cl. ..... 187/20; 187/105; 187/19; 182/142

[58] Field of Search ..... 187/20, 19, 1 R, 24, 187/25, 26, 17, 28, 105, 107; 254/268, 387; 182/142, 145, 37

[56] References Cited

U.S. PATENT DOCUMENTS

| | | | |
|---|---|---|---|
| 651,236 | 6/1900 | Corcoran . | |
| 2,573,930 | 11/1951 | Radtke . | |
| 3,924,710 | 12/1975 | Shohet | 187/19 |

FOREIGN PATENT DOCUMENTS

| | | | |
|---|---|---|---|
| 955263 | 2/1957 | Fed. Rep. of Germany . | |
| 597721 | 9/1959 | Italy | 182/142 |
| 268350 | 8/1970 | U.S.S.R. | 187/28 |
| 523017 | 8/1976 | U.S.S.R. | 187/19 |
| WO81/00105 | 2/1982 | PCT Int'l Appl. . | |

*Primary Examiner*—Joseph J. Rolla
*Assistant Examiner*—Nils E. Pedersen
*Attorney, Agent, or Firm*—Bacon & Thomas

[57] ABSTRACT

An arrangement for mounting a lift driving device to the top part of a lift cage in a lift of the type wherein the driving device includes at least two horizontally spaced driving wheels, each of which engages a respective elongate flexible member. The driving device is supported by a separate mounting frame from which the lift cage is functionally suspended by a first vibration damping support for slight movement, and the mounting frame is disposed to bear against the lift cage through a second vibration damping support, the latter support being at least slightly resilient to permit inclination of the mounting frame relative to the lift cage. Power supply to the driving device is cut off in response to sensing excessive bias of the mounting frame or a predetermined minimum spacing between the mounting frame and the lift cage.

10 Claims, 4 Drawing Sheets

ARRANGEMENT FOR MOUNTING A LIFT DRIVING DEVICE

The present invention relates to a vibration damping mounting and safety arrangement for such lifts where the driving source is mounted on top of the lift cage.

In SE-A-8501335-7 there is disclosed a lift where the driving source of the lift is disposed on top of the lift cage and drives a pair of chain wheels, each wheel engaging a respective stationary roller chain extending between the top and bottom of the lift shaft. The engagement between the chain wheels and the chains is more than tangential and preferably extends along more than half the periphery of the chain wheels. In addition to other advantages achieved by this driving arrangement the lift obtains a very smooth and vibration-free motion, especially in comparison with other types of lifts which also have their driving source placed on top of the lift cage, as in the well-known rack and screw lifts, respectively. A similar lift is disclosed in FR-A5-1,406,277.

It is an object of the present invention to further improve the noise characteristics of lifts of the above and similar types by a particular mounting arrangement of the driving device, which mounting also permits the provision of a simple and reliable safety system to stop the lift in case of chain breakage or excessive chain slackening.

Thus, the invention relates to an arrangement for mounting a lift driving device to the top part of a lift cage in a lift of the type where the driving device comprises at least two horizontally spaced driving wheels, each of which engages a respective stationary elongate flexible member, such as a chain, extending vertically, characterized in that the driving device is supported by a separate mounting frame, from which the lift cage is functionally single point suspended substantially centrally between said driving wheels via first vibration damping support means to be at least slightly movable, said mounting frame being arranged to bear against the lift cage via second vibration damping support means on both sides of the point of suspension, which are at least slightly resilient, such that inclination of the mounting frame in relation to the lift cage is allowed, and further that sensor means are provided, e.g., between the mounting frame and the lift cage, which are designed to sense excessive biasing of the mounting frame and thereby cut off the power supply to the driving device.

The expression "functionally single point suspended" as used herein means any mounting arrangement whose function is equivalent to suspension from a single defined point. Thus, e.g., a suspension from several adjacent points may be functionally equivalent to a suspension from a single point.

Further, the term "lift" in the present context is to be understood in a broad sense and is thus intended to also comprise other types of lifting devices for vertical transport than what is normally understood by lifts or elevators for the transport of persons or goods. In the same way the term "lift cage" herein is to be understood in a broad sense as the load carrier of such lifting devices.

Hereinafter the invention will be described in more detail with respect to a particular embodiment, to which it, however, is not restricted in any way. Reference is made to the accompanying drawings, wherein FIG. 1 is a schematic side-elevational view, partially in section, of a lift shaft with a lift of the type described in the introductory part;

Figure 1:
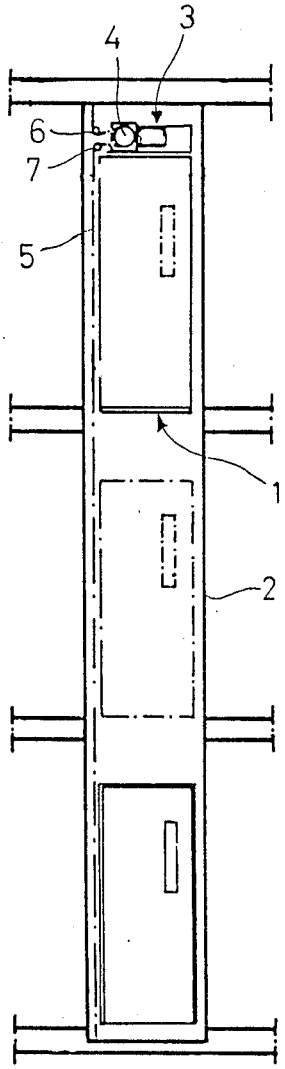
FIG. 1 PRIOR ART
Figure 2:
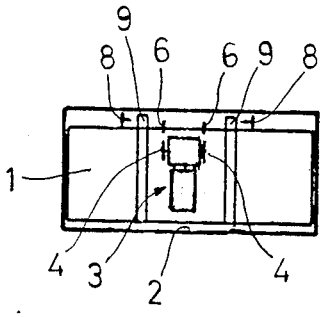
FIG. 2 PRIOR ART
FIG. 2 is a schematic top view of the lift device of FIG. 1.

FIGS. 1 and 2 schematically show a lift of the type described in the above mentioned SE-A-8501335-7. It comprises in conventional manner a lift cage 1 arranged in a lift shaft 2. A drive motor 3, e.g. an electric motor, is attached to the top frame portion of the lift cage 1. The output motor shaft is via a gear unit connected to two driving wheels 4 in the form of gear or chain wheels. The latter each engage a respective stationary chain 5, the top parts of which are attached to the roof structure of the building in question, or to a girder or similar member connected to the top part of the lift shaft. For each driving wheel 4 there is, in the illustrated case, provided a pair of upper and lower pulley wheels 6 and 7, respectively, which guide the chains 5 over the driving wheels 4, such that a considerable part of the periphery of the driving wheels engage the chains, in the illustrated case about three quarters. In general an engagement as extensive as possible is desired.

The lift cage 1 is guided in the shaft 2 via two vertical guide bars or guideways 8, with which guide means (not shown) of girder member 9 of the lift cage frame are in engagement. The rotation of the driving wheels 4 causes the lift cage 2 to be moved upwards or downwards depending on the direction of rotation. Due to the "soft" engagement of the chains 5 with the driving wheels 4 the movement of the lift cage 1 causes very little noise and a vibration-free operation.

Figure 3:
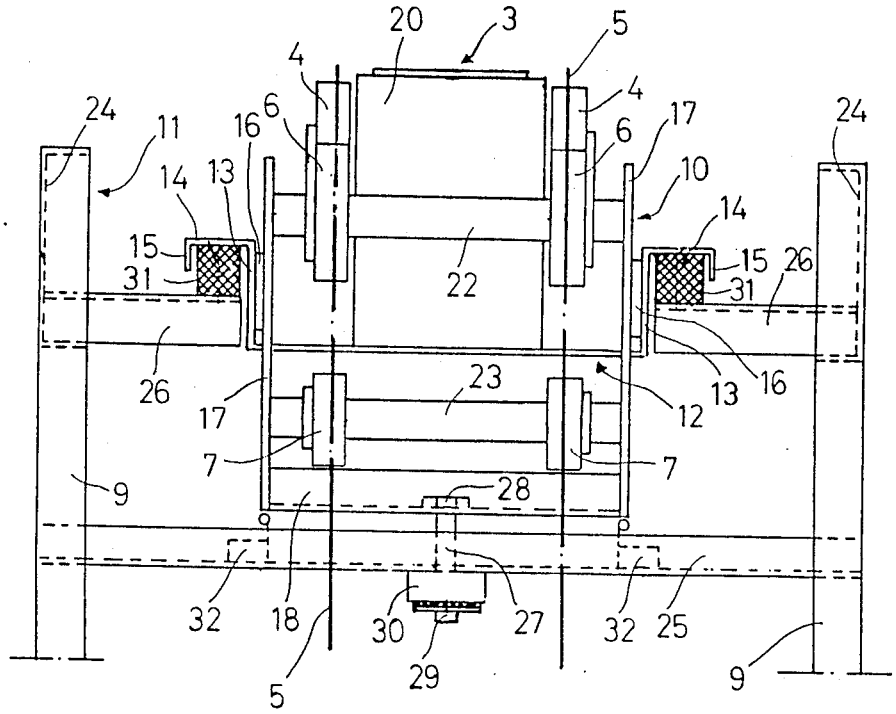
FIG. 3 is a schematic partial front view of a mounting arrangement in accordance with the invention arranged in a lift of the type shown in FIGS. 1 and 2.
Figure 4:
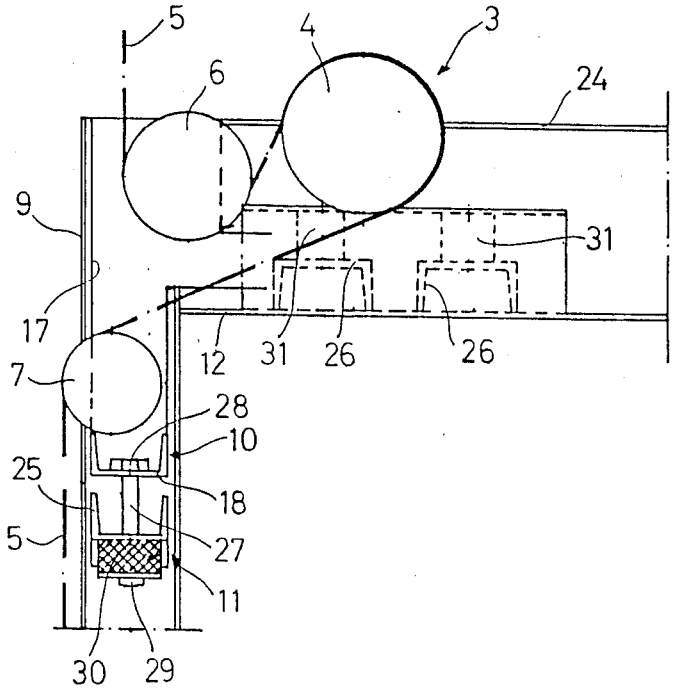
FIG. 4 is a schematic partial side-elevational view of the arrangement of FIG. 3, partially in section.
Figure 5:
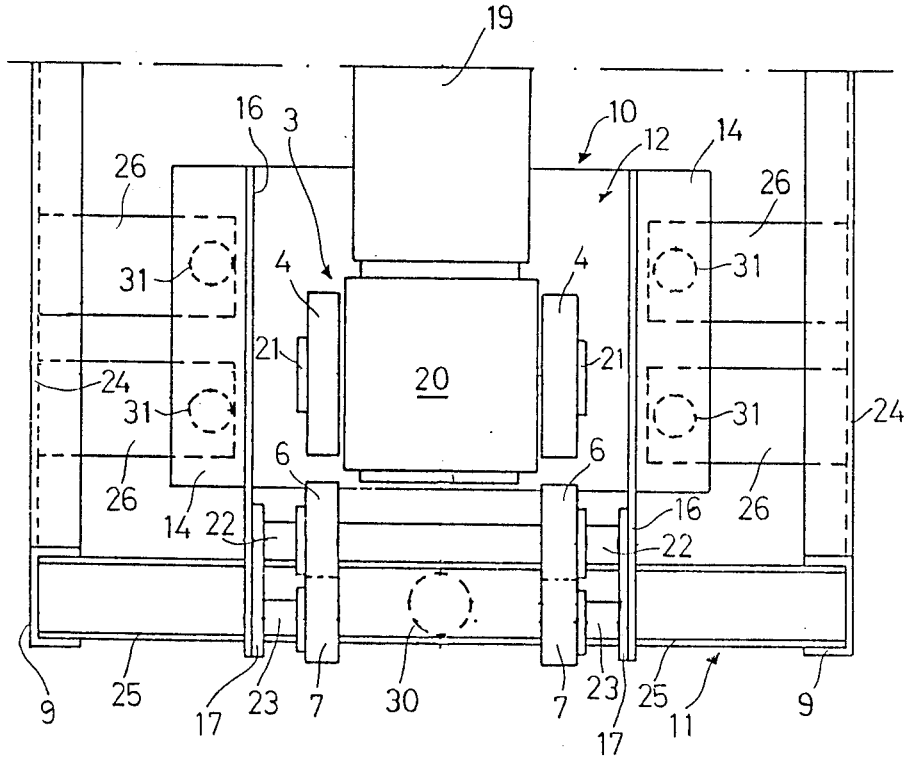
FIG. 5 is a schematic partial top view of the arrangement of FIG. 3.

The properties as to silent and vibration-free operation for a lift of the type described above and similar lifts may be further improved by the mounting arrangement according to the present invention, which in FIGS. 3–5 is shown applied to such a type of lift. Corresponding parts are provided with the same reference designations as in FIGS. 1 and 2.

The mounting arrangement according to FIGS. 3–5 comprises a mounting frame, generally designated by the reference numeral 10, which firmly anchored thereto supports a driving device for the lift, generally designated by the reference numeral 3. From the mounting frame 10 the lift cage, represented by its support frame 11, is single point suspended, as will be described in more detail below. For the sake of clarity only the top part of the support frame is shown and thus nothing of the actual lift cage. The latter is suitably itself movably suspended from the support frame 11, e.g., also single point suspended, and connected to the lower part of the support frame through suitable shock and vibration absorbing members.

In the embodiment shown the mounting frame 10 comprises a trough profile shaped member 12, whose two vertical side borders 13 at the top thereof each are provided with a horizontally projecting flange portion 14, which, in the illustrated case, has an outer edge 15 extending somewhat downwards. A respective elongate holder member 16 (best shown in FIG. 5) extends horizontally along and is firmly fixed to each of the two side borders 13. In the front part of the trough member 12 (i.e. at the bottom of FIG. 5) the holder members 16 project some distance past the member 12. To these projecting portions two vertically mounted holder members 17 are attached, which in the lower part thereof are interconnected by a horizontal elongate member 18, in the illustrated case a channel member opening upwards.

The lift driving device 3 supported by the mounting frame 10 is firmly fixed to the mounting frame and comprises a driving motor 19 having a horizontal drive shaft 21 extending from a gear box 20 and supporting two chain wheels 4 at the two opposite ends thereof. Aligned with the chain wheels 4 are two pairs of chain wheels 6 and 7, respectively, which are rotatably journalled on shafts 22, 23, attached to the vertical holder member 17 of the mounting frame 10. For the driving of the lift cage the three pairs of chain wheels 4, 6, 7 are in engagement with two stationary roller chains 5 (FIGS. 3 and 4) extending vertically in the lift shaft between the top and bottom thereof. The chain wheel pairs 6, 7 serve as pulley wheels, as best appears from FIG. 4. This lift driving system is described in more detail in the above mentioned SE-A-8501335-7, to which it is referred for further details.

The lift cage support frame 11, with the upper part of which the mounting frame 10 is arranged to cooperate, consists, in the illustrated case, of two spaced vertical girder members 9 extending along one side of the lift cage and to which the guideways of the lift cage are fixed. To the top part of the vertical girder members 9 two horizontal girder members 24 are attached which extend transversely to the girder members 9 along the top side of the lift cage. A horizontal girder member 25 is fixed to and extends between the two vertical girder members 9. Further, in the lower part of each one of the horizontal girder members 24 two horizontal support members (here inverted channels) 26 are attached perpendicularly to the girder members 24 in a spaced relationship with each other and extend above the top of the lift cage to the vicinity of the side borders 13 of the mounting frame 10. The actual lift cage is attached to the support frame 11 in any suitable manner which is not specifically described here, e.g., movably suspended as mentioned above.

Through the horizontal girder member 18 the mounting frame 10 is fixed to the horizontal girder member 25 of the lift cage frame 11 by means of a vibration damped single point suspension in the form of a bolt 27 extending through opposed bores in the two girder members 18 and 25 and kept in position by a nut 28. A vibration absorbing support member 30 is positioned between the head 29 of the bolt 27 and the underside of the girder member 25. As shown in the figure the mounting frame 10 is somewhat spaced to the girder member 25 of the lift cage frame to permit a relative restricted vertical displacement between the mounting frame 10 and the support frame 11 of the lift cage, as will be described in more detail below. For reasons readily appreciated from the following description the recess for the bolt 27 in the girder member 25 must be sufficiently large to permit a certain inclination of the bolt without giving rise to metal against metal contact.

For reasons also readily appreciated the bolt connection 27-30 should, as is shown in the figures, be positioned centrally between the chain wheel pairs 4, 6, 7 and extend in the same plane as that of the loaded part of the chains 5, i.e. the part thereof located above the pulley wheels 6 (FIG. 4). Hereby the main load component will act in the direction of the chains 5 with a minimum of moment forces on the mounting frame 10.

A vibration absorbing support member 31 is provided between each of the horizontal support members 26 of the lift cage frame 11 and the respective opposed flange portion of the through shaped member 12 of the mounting frame 10. Both these support members 31 and the above mentioned vibration damping member 30 may be of any per se conventional suitable type, preferably, however, with an extremely vibration absorbing capability, such as those in the form of whole-metallic pads of stainless spun wire, e.g., those sold under the trademark Vibrachoc ® (Vibrachoc, France).

The support frame 11 of the lift cage, and thereby the whole lift cage, is thus suspended from the mounting frame 10 of the driving device 3 in a single devibrated point by the bolt/vibration damper assembly 27-30, while the mounting frame 10 in turn is suspended from the chains 5 via the engagement of the driving device 3 therewith. The mounting frame 10 may thus be said to form a "cradle" mounted to the top part of the lift cage frame 11, which cradle via the bolt 27 in ball joint-like fashion may be inclined in any direction in relation to the lift cage frame 11 and additionally, as mentioned above, to a certain extent may be displaced vertically, such a relative movement between the mounting frame 10 and the support frame 11 of the lift cage mainly being absorbed by the vibration damping support members 31. It is appreciated that any vibrations from the driving device 3 will be efficiently damped by the support members 30 and 31, respectively, such that a minimum of vibrations is transferred to the lift cage frame, and thereby to the lift cage, when the lift is operated.

Since the support member 30 of the bolt connection 27-30 is continuously loaded by the weight of the lift cage, this support member may therefore be said to substantially have a dynamic function. The support members 31 are in contrast loaded substantially only by the weight of the mounting frame 10 (including the driving device 3) along with certain moment forces depending on the location of the chain wheels 4, 6, 7, as well as a possible relative vertical displacement of the peripheral engagement of the chains 5 with the chain wheels 6, and may therefore be said to have mainly a static function.

Due to the above described mounting arrangement of the driving source of the lift an extraordinary vibration damping may thus be obtained simultaneously with achieving an automatic positioning of the chain wheel pairs of the driving device in relation to the chains in case of displacement from an initial horizontal engagement line, as mentioned above. The construction also permits the provision of a safety system to indicate and/or cut off the power supply of the drive source in case of chain breakage or chain slackening. To this end, in the illustrated case, two contact switches 32 are provided on the horizontal girder member 25 of the lift cage frame, one on each side of the suspension bolt 27 below an opposite end portion of the mounting frame 10. The contact switches 32, which for safety reasons should be resettable by a manual operation only, are, e.g., in the case of an electric driving device 3 part of the power supply circuit thereof and are designed to be capable of cutting off the current to the driving device if the mounting frame 10 is displaced in relation to the support frame 11 of the lift cage to such an extent that it contacts one or both of the contact switches 32. As mentioned above such a displacement of the mounting frame 10 may, e.g., occur if one of the chains 5 breaks or slackens to a great extent in comparison with the other, causing the mounting frame 10 to incline to the right or left in FIG. 3 in relation to the girder member 25. Further, if, for example, both chains 5 should break or slacken excessively, the mounting frame 10 will be displaced vertically towards the girder member 25, which also will cause the contact switches 32 to break the power supply circuit.

The invention is, of course, not restricted to the embodiment described above and shown in the drawings, but it may be modified in various ways within the scope of the inventive concept as defined in the claims. Thus, e.g., the number and/or design of the support/vibration damper members 30, 31 may be changed. Similarly, the design and positioning of the safety switches 32, as well as the number thereof, may be varied in different ways and adapted to various other driving systems, such as hydraulics, etc. Of course, it would also be possible to use suitable sensors instead of the switches 32 and provide the very switching function in another location. The sensing of the relative displacement may also be effected by suitable sensors/switches sensing the inclination of the bolt 27 in relation to the vertical line. Similarly, as mentioned above, the "single point suspension" of the support frame 11 of the lift cage from the mounting frame 10 need not be provided by a single bolt/damper assembly 27-30, but a corresponding function may be obtained by two or possibly more adjacent such assemblies.

I claim:

1. An arrangement for mounting a lift driving device to the top part of a lift cage in a lift of the type wherein the driving device includes at least two horizontally spaced driving wheels, each wheel engaging a corresponding stationary and vertically extending elongate flexible member, such as a chain, the arrangement comprising a driving device being supported by a separate mounting frame from which a lift cage is functionally single point suspended substantially centrally between at least two driving wheels by a first vibration damping support means and being at least slightly movable, the mounting frame being arranged to bear against the lift cage through a second vibration damping support means on both sides of the suspension, the second vibration damping support means being at least slightly resilient to permit inclination of the mounting frame relative to the lift cage, and sensor means for cutting off power supply to the driving device upon sensing excessive biasing of the mounting frame.

2. The arrangement of claim 1 wherein vertical movement of the mounting frame is restricted relative to the lift cage, and the sensor means further includes means for sensing vertical displacement of the mounting frame to cut off power supply to the driving device when a predetermined minimum spacing between the mounting frame and the lift cage is sensed.

3. The arrangement of claim 1 wherein the sensor means is disposed between the mounting frame and the lift cage.

4. The arrangement of claim 2 wherein the means for sensing vertical displacement is disposed between the mounting frame and the lift cage.

5. The arrangement of claim 2 wherein the means for sensing excessive biasing and the means for sensing vertical displacement of the mounting frame are the same.

6. The arrangement of claim 1 further including a corresponding elongate flexible member engagable by each driving wheel, and the single point suspension of the lift cage from the mounting frame is disposed substantially in the plane defined by the stationary elongate members.

7. The arrangement of claim 1 wherein the single point suspension of the lift cage from the mounting frame includes a bolt connecting the lift cage to the first vibration damping support means.

8. The arrangement of claim 1 wherein at least one of the first and second vibration damping support means includes whole-metallic vibration members of spun wire.

9. The arrangement of claim 1 wherein the sensor means includes a contact switch.

10. The arrangement of claim 1 wherein the lift cage includes a support frame single point suspended from the mounting frame.

* * * * *